US011959383B2

(12) United States Patent
Feng et al.

(10) Patent No.: US 11,959,383 B2
(45) Date of Patent: Apr. 16, 2024

(54) METHOD AND DEVICE FOR CARRYING OUT GROUTING BETWEEN ADJACENT GATEROADS IN INTERNAL-STAGGERED SPLIT-LEVEL COAL MINING

(71) Applicant: Taiyuan University of Technology, Taiyuan (CN)

(72) Inventors: Guorui Feng, Taiyuan (CN); Yijiang Fan, Taiyuan (CN); Pengfei Wang, Taiyuan (CN); Chenliang Hao, Taiyuan (CN); Xiaoze Wen, Taiyuan (CN); Jun Guo, Taiyuan (CN); Jinwen Bai, Taiyuan (CN); Tingye Qi, Taiyuan (CN); Jianan Liu, Taiyuan (CN); Linjun Zhu, Taiyuan (CN); Changquan Wu, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 17/752,842

(22) Filed: May 24, 2022

(65) Prior Publication Data

US 2022/0282619 A1 Sep. 8, 2022

(30) Foreign Application Priority Data

May 25, 2021 (CN) ..... 202110569738.X

(51) Int. Cl.
*E21C 41/18* (2006.01)
*E21D 20/02* (2006.01)

(52) U.S. Cl.
CPC ..... *E21C 41/18* (2013.01); *E21D 20/028* (2013.01)

(58) Field of Classification Search
CPC ..... E21C 41/18
See application file for complete search history.

(56) References Cited

U.S. PATENT DOCUMENTS 10,989,051 B2 * 4/2021 Xie ..... E21C 41/18

FOREIGN PATENT DOCUMENTS

| | | | | |
|---|---|---|---|---|
| CN | 1558090 A | * | 12/2004 | |
| CN | 108843354 A | * | 11/2018 | |
| CN | 110374600 A | | 10/2019 | |
| CN | 110080767 B | * | 11/2020 | ..... E21C 41/18 |

* cited by examiner

*Primary Examiner* — Janine M Kreck

(57) ABSTRACT

A method for carrying out grouting between adjacent gateroads in internal-staggered split-level coal mining. A return air gateroad of a stoping face and an inlet air gateroad of a heading face are not on the same level. The return air gateroad of the stoping face is arranged along a roof of a coal seam. The inlet air gateroad of the heading face is arranged along a floor of the coal seam. There is a height difference between the return air gateroad and the inlet air gateroad in a vertical direction. During the construction process, the inlet air gateroad is excavated at a delay distance of 180-200 meters from the return air gateroad. The drilling and grouting are performed while excavating the roadway, where grouting holes are arranged in a single row. A device for implementing the method is also provided.

4 Claims, 3 Drawing Sheets

METHOD AND DEVICE FOR CARRYING OUT GROUTING BETWEEN ADJACENT GATEROADS IN INTERNAL-STAGGERED SPLIT-LEVEL COAL MINING

CROSS-REFERENCE TO RELATED APPLICATIONS

This application claims the benefit of priority from Chinese Patent Application No. 202110569738.X, filed on May 25, 2021. The content of the aforementioned application, including any intervening amendments thereto, is incorporated herein by reference in its entirety.

TECHNICAL FIELD

This application relates to coal mining, and more particularly to a method and a device for carrying out grouting between adjacent gateroads in internal-staggered split-level coal mining, in which the roadway is stabilized through grouting using a composite grouting pipe and special arrangement of rock bolts.

BACKGROUND

In the internal-staggered split-level coal mining method, there is a grouting staggered area between a return air gateroad of a stoping face and an inlet air gateroad of a heading face. Considering that these two gateroads are not on the same level, the arrangement of grouting holes, angle of the bolt support and type of the grouting pipe would largely influence the support effect.

The traditional grouting is performed usually using a three-hole grouting pipe, on which the grouping holes are arranged at an interval of 120°, so as to provide a large enough grouting pressure to allow the grout to the desired depth of the coal seam along the coal-seam cracks, significantly enhancing the grouting effect. However, the 120° interval is too large to realize the multi-angle grouting on the coal seam around the grouting pipe. In addition, the rock bolts are basically the same in length, such that only part of the coal seam around the roadway can be reinforced.

Therefore, realizing the multi-angle grouting and the enlargement of the part of the coal seam reinforced by the rock bolts is of great significance for saving energy and improving the roadway reinforcement.

SUMMARY

An objective of the present disclosure is to provide a device to perform the multi-angle and omni-directional grouting between adjacent gateroads and provide a method for arranging rock bolts to provide a more stable reinforcement effect on the coal seam. The device has simple structure, easy operation and low cost, and employs a hollow rock bolt as the grouting pipe. This application enables a stable reinforcement on the coal seam between adjacent gateroads in the internal-staggered split-level coal mining.

In a first aspect, the present disclosure provides a method for carrying out grouting between adjacent gateroads in internal-staggered split-level coal mining, the method comprising:

excavating a roadway;

drilling grouting holes; and performing grouting through the grouting holes while excavating the roadway;

wherein a stoping coal seam is a thick coal seam; a return air gateroad of a stoping face and an inlet air gateroad of a heading face are not on the same level; the return air gateroad of the stoping face is arranged along a roof of the stoping coal seam; the inlet air gateroad of the heading face is arranged along a floor of the stoping coal seam; there is a height difference between the return air gateroad of the stoping face and the inlet air gateroad of the heading face in a vertical direction; and during construction, the inlet air gateroad of the heading face is excavated at a delay distance of 180-200 m from the return air gateroad of the stoping face such that an inlet air gateroad of a next heading face is excavated after the return air gateroad of the stoping face is stable; and the grouting holes are arranged in a single row.

In some embodiments, rock bolts of a roof of the inlet air gateroad and rock bolts of a floor of the return air gateroad are staggeredly arranged such that in a direction along the roadway, any row of rock bolts on the floor of the return air gateroad is arranged between two adjacent rows of rock bolts on the roof of the inlet air gateroad to prevent mutual interference along the roadway.

In some embodiments, four grouting holes are arranged in each row on a floor of the return air gateroad; the four grouting holes in each row are respectively a first grouting hole, a second grouting hole, a third grouting hole and a fourth grouting hole from a first side of the floor of the return air gateroad to a second side of the floor of the return air gateroad; the first grouting hole is at an angle of 30° to the floor of the return air gateroad, and is inclined downward towards the first side of the floor of the return air gateroad, so as to extend into a coal seam on a side of the inlet air gateroad; the second grouting hole is at an angle of 30° to the floor of the return air gateroad, and is inclined downward towards the first side of the floor of the return air gateroad, so as to extend into a coal seam above a roof of the inlet air gateroad; the fourth grouting hole is at an angle of 45° to a coal seam at the floor of the return air gateroad, and is inclined downward towards the second side of the floor of the return air gateroad; and the third grouting hole is perpendicular to the coal seam at the floor of the return air gateroad.

In some embodiments, after support of the return air gateroad is stabilized, the inlet air gateroad is excavated; four grouting holes are arranged in each row on a roof of the inlet air gateroad; the four grouting holes in each row are respectively a first grouting hole, a second grouting hole, a third grouting hole and a fourth grouting hole from a first side of the roof of the inlet air gateroad to a second side of the roof of the inlet air gateroad, the first grouting hole and the second grouting hole are both at an angle of 45° to the roof of the inlet air gateroad, and are inclined upward towards the first side of the roof of the inlet air gateroad in a parallel manner, so as to extend into a coal seam below a floor of the return air gateroad; the fourth grouting hole is at an angle of 45° to the coal seam, and is inclined upward towards the second side of the roof of the inlet air gateroad, so as to extend into the coal seam below the floor of the return air gateroad; and the third grouting hole is perpendicular to a coal seam at the roof of the inlet air gateroad.

In a second aspect, the present disclosure provides carrying out grouting between adjacent gateroads in internal-staggered split-level coal mining, the device comprising:

a grouting pipe;

a drilling rig;

a drilling tool;

a grouting pump;
a stirrer;
a deliver pipeline;
a packer;
a mixer; and
a rock bolt;

wherein the drilling rig and the drilling tool are configured for hole drilling; the stirrer is configured to prepare a grout; the delivery pipeline is configured to transport the grout; the grouting pump is configured to provide a pressure to transport the grout to a target position through the delivery pipeline; and after the rock bolt is placed into a drill hole, the grouting pump is connected to an end of the rock bolt through the delivery pipeline, and the grout is fed to the rock bolt under the pressure provided by the grouting pump to perform grouting.

In some embodiments, the grouting pipe is composed of an inner grouting pipe and an outer grouting pipe; the inner grouting pipe is annular, and is evenly provided with three first through holes along a circumferential direction of a cross section of the inner grouting pipe; an outer side of each of the three first through holes is provided with a connecting pipe for connection with the outer grouting pipe; the outer grouting pipe is annular, and is evenly provided with six second through holes along a circumferential direction of a cross section of the outer grouting pipe; two adjacent second through holes constitute a through-hole group, and a boss is arranged between two adjacent through-hole groups; and a slot is arranged on an intersection between the cross section of the outer grouting pipe and an inner wall of the outer grouting pipe and is arranged between two adjacent bosses; and the inner grouting pipe is arranged inside the outer grouting pipe, and is configured to be rotatable in the slot on the inner wall of the outer grouting pipe;

when the grout is injected from the inner grouting pipe, a grouting pressure is sufficient.

An angle between two adjacent second through holes is 60°; a height difference between the boss and the slot is 5 mm; when the grouting is started, the three first through holes are aligned with three of the six second through holes; after the grouting is performed for a preset period of time, the inner grouting pipe is rotated by 60°, such that the three first through holes are aligned with the other three of the six second through holes at an interval of 120°, so as to continue performing the grouting; and after the grouting is completed, the inner grouting pipe is extracted and used for a grouting area in front of a roadway. The grouting pipe provided herein can realize multi-angle and all-round grouting inside the coal seam while ensuring the grouting pressure, so as to provide a more remarkable grouting effect inside the coal seam.

During the grouting, a length of the grouting pipe is consistent with that of the grouting holes mentioned above.

The beneficial effects of the present disclosure are described as follows.

The grouting device provided herein can realize the multi-angle and omni-directional grouting inside the underground coal seam, and provide a more remarkable grouting effect inside the coal seam. In addition, the grouting device has small size, simple structure and easy operation, and can enhance the reinforcement of the coal seam around the roadway without using additional rock bolts. The disclosure do not increase the workload during grouting, and can bring significant economic benefits.

Figure 1:
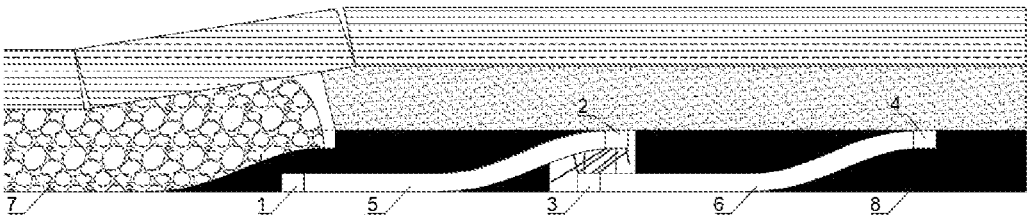
FIG. 1 schematically depicts a roadway layout on a stoping face in internal-staggered split-level coal mining.

In the drawings, 1, inlet air gateroad of a stoping face; 2, return air gateroad of the stoping face; 3, inlet air gateroad of a heading face; 4, return air gateroad of the heading face; 5, stoping face; 6, heading face; 7, gob; 8, stoping coal seam; 9, second grouting hole group; 10, first grouting hole group; 11, through hole; 12, outer grouting pipe; 13, inner grouting pipe; 14, power source; 15, motor; 16, stirrer; 17, grouting pump; 18, delivery pipeline; and 19, composite grouting pipe.

DETAILED DESCRIPTION OF EMBODIMENTS

The present disclosure will be further described below with reference to the embodiments. It should be noted that the embodiments provided herein are merely illustrative, and not intended to limit the present disclosure.

As shown in FIGS. 1-6, a device for carrying out grouting between adjacent gateroads in internal-staggered split-level coal mining includes a grouting pipe, a drilling rig, a drilling tool, a grouting pump, a stirrer, a deliver pipeline, a packer and a mixer. The drilling rig and the drilling tool are configured for hole-forming. The grouting pump, the stirrer and other apparatus are configured to prepare and transport a grout. Particularly, the stirrer is configured to prepare the grout; the grouting pipe is configured to transport the grout; and the grouting pump is configured to provide a pressure to transport the grout to a target position through the deliver pipeline. After a rock bolt is placed into a drill hole, the grouting pump is connected to an end of the rock bolt through the deliver pipeline, and the grout is fed to the rock bolt under the pressure provided by the grouting pump to perform grouting.

wherein a stoping coal seam 8 is a thick coal seam, in front of the goaf 7 are the stoping face 5 and the excavation face 6 respectively; the two sides of the stoping face 5 are the inlet air gateroad 1 and the return air gateroad 2 of the mining face respectively; the two sides of the excavation face 6 are the air inlet gateroad 3 of the excavation face and the return air gateroad 4 of the excavation face; a return air gateroad of a stoping face 2 and an inlet air gateroad of a heading face 3 are not on the same level; the return air gateroad of the stoping face 2 is arranged along a roof of the stoping coal seam 8; the inlet air gateroad of the heading face 3 is arranged along a floor of the stoping coal seam 8; there is a height difference between the return air gateroad of the stoping face 2 and the inlet air gateroad of the heading face 3 in a vertical direction; and during construction, the inlet air gateroad of the heading face 3 is excavated at a delay distance of 180-200 m from the return air gateroad of the stoping face 2 such that an inlet air gateroad of a next heading face is excavated after the return air gateroad of the stoping face 2 is stable.

The grouting pipe is a composite grouting pipe, and the composite grouting pipe is composed of an inner grouting pipe 13 and an outer grouting pipe 12. The inner grouting pipe 13 is annular, and is evenly provided with three first through holes 11 along a circumferential direction of a cross section of the inner grouting pipe 13. An outer side of each of the three first through holes is provided with a connecting pipe for connection with the outer grouting pipe 12. The outer grouting pipe 12 is annular, and is evenly provided with six second through holes along a circumferential direction of a cross section of the outer grouting pipe 12. Two adjacent second through holes constitute a through-hole group, and a boss is arranged between two adjacent through-hole groups. A slot is arranged on an intersection between the cross section of the outer grouting pipe 12 and an inner wall of the outer grouting pipe 12 and is arranged between two adjacent bosses. The inner grouting pipe 13 is arranged inside the outer grouting pipe 12, and is configured to be rotatable in the slot on the inner wall of the outer grouting pipe 12.

An angle between two adjacent second through holes is 60°. A height difference between the boss and the slot is 5 mm. When the grouting is started, the three first through holes of the inner grouting pipe are aligned with three of the six second through holes of the outer grouting pipe. After the grouting is performed for a preset period of time, the inner grouting pipe is rotated by 60°, such that the three first through holes of the inner grouting pipe are aligned with the other three second through holes at an interval of 120°, so as to continue performing the grouting. After the grouting is completed, the inner grouting pipe is extracted and used for a grouting area in front of a roadway.

Figure 2:
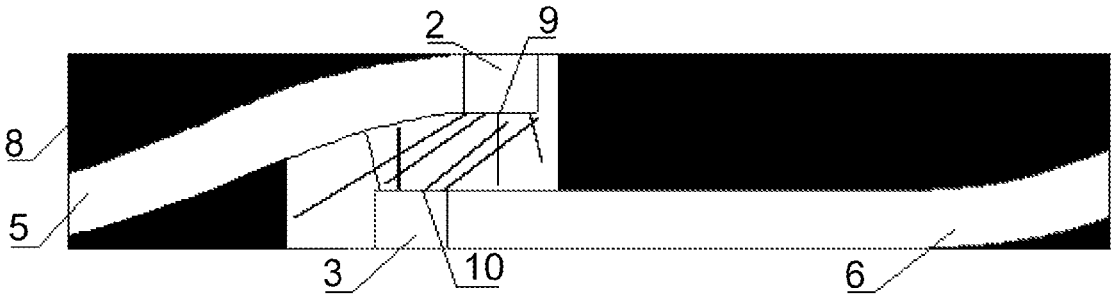
FIG. 2 schematically depicts arrangement of rock bolts in a staggered grouting area between adjacent gateroads in the internal-staggered split-level coal mining.
Figure 3:
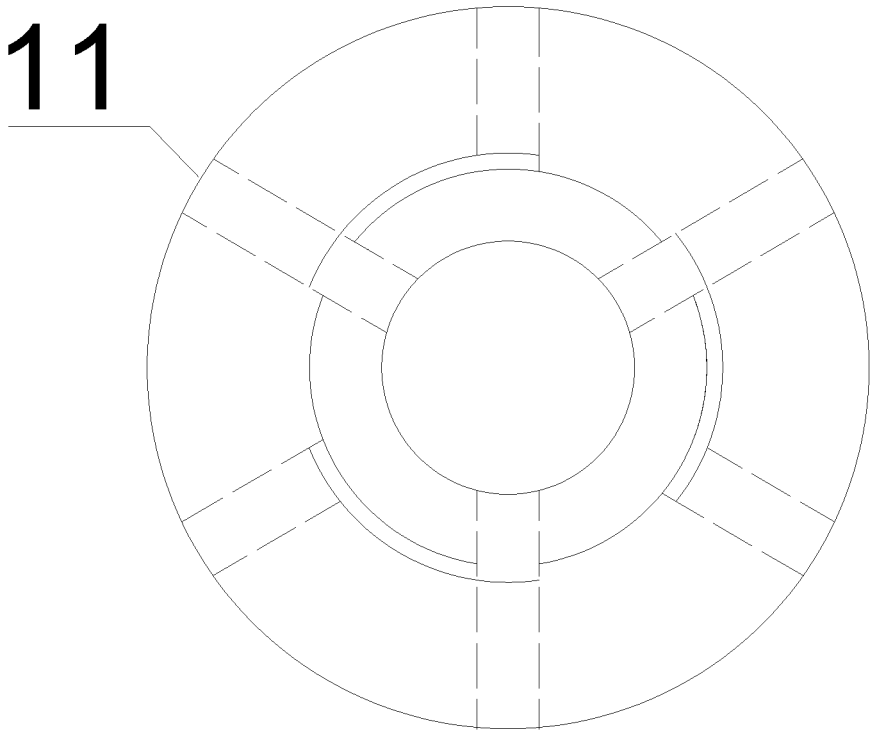
FIG. 3 is a cross-sectional view of a composite grouting pipe.
Figure 4:
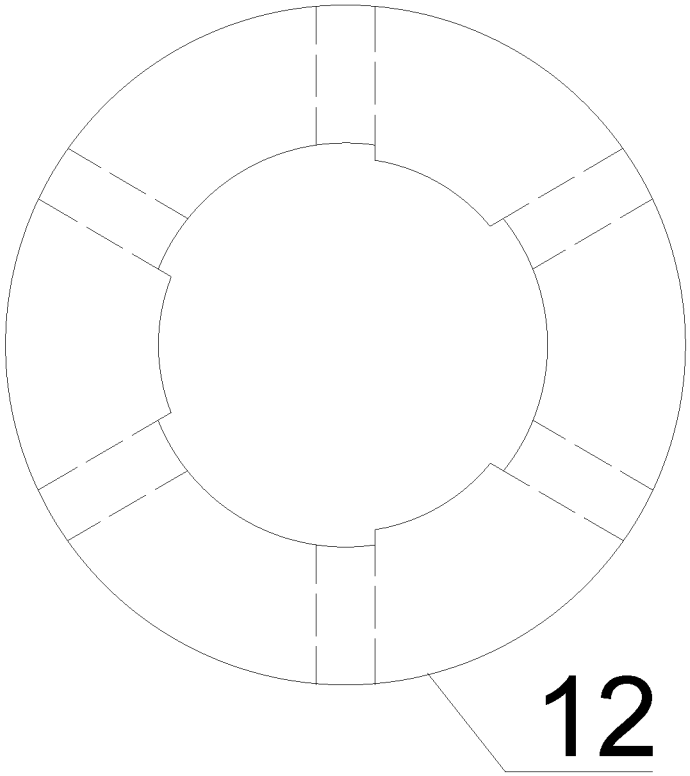
FIG. 4 is a cross-sectional view of an outer grouting pipe.
Figure 5:
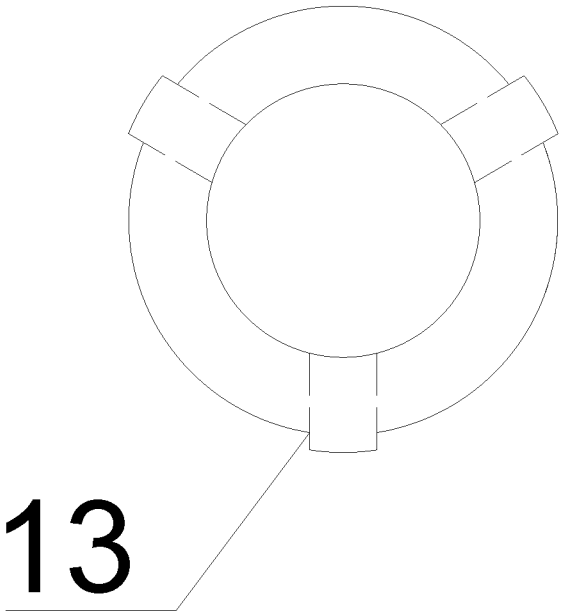
FIG. 5 is a cross-sectional view of an inner grouting pipe.

In the internal-staggered split-level coal mining, a stoping coal seam 8 is a thick coal seam. A return air gateroad 2 of a stoping face is adjacent to an inlet air gateroad 3 of a heading face, but they are not on the same level. The return air gateroad 2 is arranged along a roof of the stoping coal seam, and the inlet air gateroad 3 is arranged along a floor of the stoping coal seam. During the construction, the inlet air gateroad 3 is excavated at a delay distance of about 200 meters from the return air gateroad 2, such that the inlet air gateroad 3 is excavated after the return air gateroad 2 is stable. During the drilling and grouting in the roadway, grouting holes are arranged in a single row, a first grouting hole group 10 (rock bolts) on a roof of the inlet air gateroad of the heading face and a second grouting hole group 9 (rock bolts) on a floor of the return air gateroad of the stoping face are staggeredly arranged. The first grouting hole group 10 includes a first grouting hole, a second grouting hole, a third grouting hole and a fourth grout hole. The second grouting hole group 9 includes a fifth grouting hole, a sixth grouting hole, a seventh grouting hole and an eighth grouting hole. As shown in FIG. 2, when drilling the grouting holes, the first grouting hole is at an angle of 30° to the floor of the return air gateroad, and is inclined downward towards a left side of the floor of the return air gateroad, so as to extend into a coal seam on a left side of the inlet air gateroad; the second grouting hole is at an angle of 30° to the floor of the return air gateroad, and is inclined downward towards the left side of the floor of the return air gateroad, so as to extend into the coal seam at a roof of the inlet air gateroad; the third grouting hole is at an angle of 45° to the coal seam at the floor of the return air gateroad, and is inclined downward towards the right side of the floor of the return air gateroad; and the fourth grouting hole is perpendicular to the coal seam at the floor of the return air gateroad. The fifth grouting hole and the sixth grouting hole are both at an angle of 45° to the roof of the inlet air gateroad, and are inclined upward towards to the right side of the roof of the inlet air gateroad in a parallel manner, so as to extend into the floor of the return air gateroad; the seventh grouting hole of the second grouting hole group 9 is at an angle of 45° to the coal seam, and is inclined upward towards the left side of the roof of the inlet air gateroad, so as to extend to a vicinity of the floor of the return air gateroad; and the eighth grouting hole is perpendicular to the coal seam at the roof of the inlet air gateroad. When the grouting is started through the composite grouting pipe 19, the first three through holes of the inner grouting pipe 13 are aligned with three of the six second grouting holes of the outer grouting pipe 12. After the grouting is performed for a preset period of time, the inner grouting pipe 13 is rotated clockwise by 60°, such that the three first through holes of the inner grouting pipe 13 are aligned with the other three second through holes of the outer grouting pipe 12, so as to continue performing grouting. After the grouting is completed, the inner grouting pipe 13 is extracted and used for the grouting area in front of the roadway. Such operations are repeated.

Figure 6:
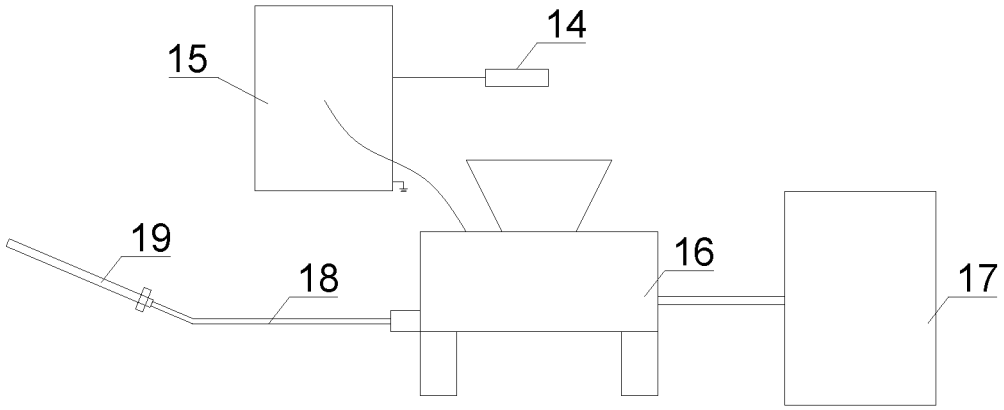
FIG. 6 is a schematic diagram of a grouting process.

As shown in FIG. 6, after the drilling rig has drilled the grouting holes, the power supply 14 is turned on, and a motor 15 starts to work. After materials for preparing the grout are put into the stirrer 16, the stirrer 16 is started. Driven by the motor 15, the stirrer 16 starts to work to produce the grout. After the grout is prepared, the grouting pump 17 is started to provide a pressure to transport the grout in the stirrer 16 to the composite grouting pipe 19 through the deliver pipeline 18, so as to perform grouting.

What is claimed is:

1. A method for carrying out grouting between adjacent gateroads in internal-staggered split-level coal mining, the method comprising:

excavating a roadway;

drilling grouting holes; and performing grouting through the grouting holes while excavating the roadway;

wherein a stoping coal seam is a thick coal seam; a return air gateroad of a stoping face and an inlet air gateroad of a heading face are not on the same level; the return air gateroad of the stoping face is arranged along a roof of the stoping coal seam; the inlet air gateroad of the heading face is arranged along a floor of the stoping coal seam; there is a height difference between the return air gateroad of the stoping face and the inlet air gateroad of the heading face in a vertical direction; and during construction, the inlet air gateroad of the heading face is excavated at a delay distance of 180-200 m from the return air gateroad of the stoping face such that an inlet air gateroad of the heading face is excavated after the return air gateroad of the stoping face is stable; and wherein each gateroad is a roadway created by excavating the roadway; drilling grouting holes; and performing grouting through the grouting holes while excavating the roadway.

2. The method of claim 1, wherein rock bolts of a roof of the inlet air gateroad and rock bolts of a floor of the return air gateroad are staggeredly arranged such that in a direction along the roadway, any row of rock bolts on the floor of the return air gateroad is arranged between two adjacent rows of rock bolts on the roof of the inlet air gateroad to prevent mutual interference along the roadway.

3. The method of claim 1, wherein four grouting holes are arranged in each row on a floor of the return air gateroad; the four grouting holes in each row are respectively a first grouting hole, a second grouting hole, a third grouting hole and a fourth grouting hole from a first side of the floor of the return air gateroad to a second side of the floor of the return air gateroad; the first grouting hole is at an angle of 30° to the floor of the return air gateroad, and is inclined downward towards the first side of the floor of the return air gateroad, so as to extend into the stoping coal seam on the first side of the floor of the inlet air gateroad; the second grouting hole is at an angle of 30° to the floor of the return air gateroad, and is inclined downward towards the first side of the floor of the return air gateroad, so as to extend into the stoping coal seam above a roof of the inlet air gateroad; the fourth grouting hole is at an angle of 45° to the stoping coal seam at the floor of the return air gateroad, and is inclined downward towards the second side of the floor of the return air gateroad; and the third grouting hole is perpendicular to the stoping coal seam at the floor of the return air gateroad.

4. The method of claim 1, wherein after support of the return air gateroad is stabilized, the inlet air gateroad is excavated; four grouting holes are arranged in each row on a roof of the inlet air gateroad; the four grouting holes in each row are respectively a first grouting hole, a second grouting hole, a third grouting hole and a fourth grouting hole from a first side of the roof of the inlet air gateroad to a second side of the roof of the inlet air gateroad, the first grouting hole and the second grouting hole are both at an angle of 45° to the roof of the inlet air gateroad, and are inclined upward towards the first side of the roof of the inlet air gateroad in a parallel manner, so as to extend into the stoping coal seam below a floor of the return air gateroad; the fourth grouting hole is at an angle of 45° to the stoping coal seam, and is inclined upward towards the second side of the roof of the inlet air gateroad, so as to extend into the stoping coal seam below the floor of the return air gateroad; and the third grouting hole is perpendicular to the stoping coal seam at the roof of the inlet air gateroad.

* * * * *